US008939063B2

(12) United States Patent
Rechenmacher, Jr.

(10) Patent No.: US 8,939,063 B2
(45) Date of Patent: Jan. 27, 2015

(54) HYDRAULIC ENGINE WITH INFINITY DRIVE

(75) Inventor: William Rhett Rechenmacher, Jr., Justin, TX (US)

(73) Assignee: BB Motor Corp, LLC, Roanoke, TX (US)

( * ) Notice: Subject to any disclaimer, the term of this patent is extended or adjusted under 35 U.S.C. 154(b) by 1039 days.

(21) Appl. No.: 13/058,823

(22) PCT Filed: Jul. 24, 2009

(86) PCT No.: PCT/US2009/051669

§ 371 (c)(1),
(2), (4) Date: Jul. 8, 2011

(87) PCT Pub. No.: WO2010/011909

PCT Pub. Date: Jan. 28, 2010

(65) Prior Publication Data

US 2011/0308239 A1 Dec. 22, 2011

Related U.S. Application Data

(60) Provisional application No. 61/137,032, filed on Jul. 25, 2008.

(51) Int. Cl.
*F04B 9/04* (2006.01)
*F04B 7/00* (2006.01)

(52) U.S. Cl.
CPC ..... *F04B 9/047* (2013.01); *F04B 7/0046* (2013.01)
USPC ..... 92/71; 91/501

(58) Field of Classification Search
USPC ..... 91/218, 499, 501, 502, 507; 92/71
See application file for complete search history.

(56) References Cited

U.S. PATENT DOCUMENTS

| | | | | | |
|---|---|---|---|---|---|
| 1,127,267 | A | * | 2/1915 | McElwain | 92/71 |
| 1,229,009 | A | * | 6/1917 | Allison | 91/502 |
| 1,239,310 | A | * | 9/1917 | Shepard | 92/71 |
| RE15,756 | E | * | 2/1924 | Michell | 91/502 |
| 1,867,504 | A | * | 7/1932 | Franklin | 74/57 |
| 1,918,840 | A | * | 7/1933 | Eriksen | 123/56.8 |
| 2,388,644 | A | * | 11/1945 | Roessler | 91/502 |

(Continued)

OTHER PUBLICATIONS

Communication fromr Chinese foreign associate dated Apr. 2, 2013, including Office Action and Search Report from Chinese patent office; 14 pages.

*Primary Examiner* — Thomas E Lazo
(74) *Attorney, Agent, or Firm* — Fish & Richardson P.C.

(57) ABSTRACT

A system comprises a first piston comprising a first piston shaft and a first drive pin. A first piston cylinder comprises a first body and a first groove, wherein the first groove defines a first aperture, the first aperture oriented axially along the first body and configured to receive the first drive pin. The first body encloses the first piston and allows the first piston to travel axially within the first piston cylinder. A drive shaft comprises an axis, a drive groove, and a surface, wherein the drive groove forms a continuous channel along the surface and receives the first drive pin. In one embodiment, a first distribution wheel comprises a first face, a second face, a first inlet aperture, and a first outlet aperture. The first distribution wheel couples to the first piston cylinder and to the drive shaft at a first end of the drive shaft, and rotates axially with the drive shaft along the axis of the drive shaft. The first inlet aperture allows hydraulic fluid to pass through the first face and the second face and the first outlet aperture defines a groove on the second face.

5 Claims, 15 Drawing Sheets

(56) References Cited

U.S. PATENT DOCUMENTS

| | | | | | |
|---|---|---|---|---|---|
| 2,839,008 | A | * | 6/1958 | Stansfield et al. | 91/502 |
| 3,967,535 | A | * | 7/1976 | Rozansky | 91/502 |
| 4,090,478 | A | * | 5/1978 | Trimble et al. | 92/71 |
| 4,184,409 | A | | 1/1980 | Hinchman et al. | |
| 4,346,645 | A | * | 8/1982 | Wusthof et al. | 91/501 |
| 4,571,946 | A | * | 2/1986 | Demopoulos | 123/56.8 |
| 4,700,613 | A | | 10/1987 | Tiljander | |
| 4,887,558 | A | * | 12/1989 | Bernard | 123/57.1 |
| 5,044,456 | A | | 9/1991 | Hayashi et al. | |
| 6,145,482 | A | * | 11/2000 | Blount | 123/45 A |
| 6,938,590 | B2 | * | 9/2005 | Buelna | 92/71 |
| 7,721,685 | B2 | * | 5/2010 | Page | 123/56.8 |
| 7,726,951 | B2 | * | 6/2010 | Jansen et al. | 417/270 |

* cited by examiner

HYDRAULIC ENGINE WITH INFINITY DRIVE

TECHNICAL FIELD

The present invention relates generally to the fields of mechanical energy transformation and, in particular, to a hydraulic engine with infinity drive.

BACKGROUND OF THE INVENTION

Many modern machines take rotational energy as an input. For example, common generators typically receive rotational energy at a shaft and produce electrical energy as an output. As another example, a common mill receives rotational energy as an input and uses the rotational energy to turn a grindstone. Over the past several centuries, many engines have been developed to provide rotational energy, including engines that rely on dense, viscous fluid as a mechanical power carrier, such as hydraulic engines, for example.

Common hydraulic engines suffer from a number of drawbacks. For example, some hydraulic engines have multiple drive shafts and a high number of moving parts. As such, typical hydraulic engines require complex lubrication systems and high maintenance and repair costs. Further, some hydraulic engines generate a great deal of internal friction, which can expose the internal parts to heat damage.

Therefore, there is a need for a system and/or method that addresses at least some of the problems and disadvantages associated with conventional systems and methods.

BRIEF SUMMARY

The following summary is provided to facilitate an understanding of some of the innovative features unique to the embodiments disclosed and is not intended to be a full description. A full appreciation of the various aspects of the embodiments can be gained by taking into consideration the entire specification, claims, drawings, and abstract as a whole.

A system comprises a first piston comprising a first piston shaft and a first drive pin. A first piston cylinder comprises a first body and a first groove, wherein the first groove defines a first aperture, the first aperture oriented axially along the first body and configured to receive the first drive pin. The first body encloses the first piston and allows the first piston to travel axially within the first piston cylinder. A drive shaft comprises an axis, a drive groove, and a surface, wherein the drive groove forms a continuous channel along the surface and receives the first drive pin. In one embodiment, a first distribution wheel comprises a first face, a second face, a first inlet aperture, and a first outlet aperture. The first distribution wheel couples to the first piston cylinder and to the drive shaft at a first end of the drive shaft, and rotates axially with the drive shaft along the axis of the drive shaft. The first inlet aperture allows hydraulic fluid to pass through the first face and the second face and the first outlet aperture defines a groove on the second face.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope of the invention. While numerous specific details are set forth to provide a thorough understanding of the present invention, those skilled in the art will appreciate that the present invention may be practiced without such specific details. In other instances, well-known elements have been illustrated in schematic or block diagram form in order not to obscure the present invention in unnecessary detail. Additionally, many modifications and variations will be apparent to one of ordinary skill in the relevant arts.

Figure 1:
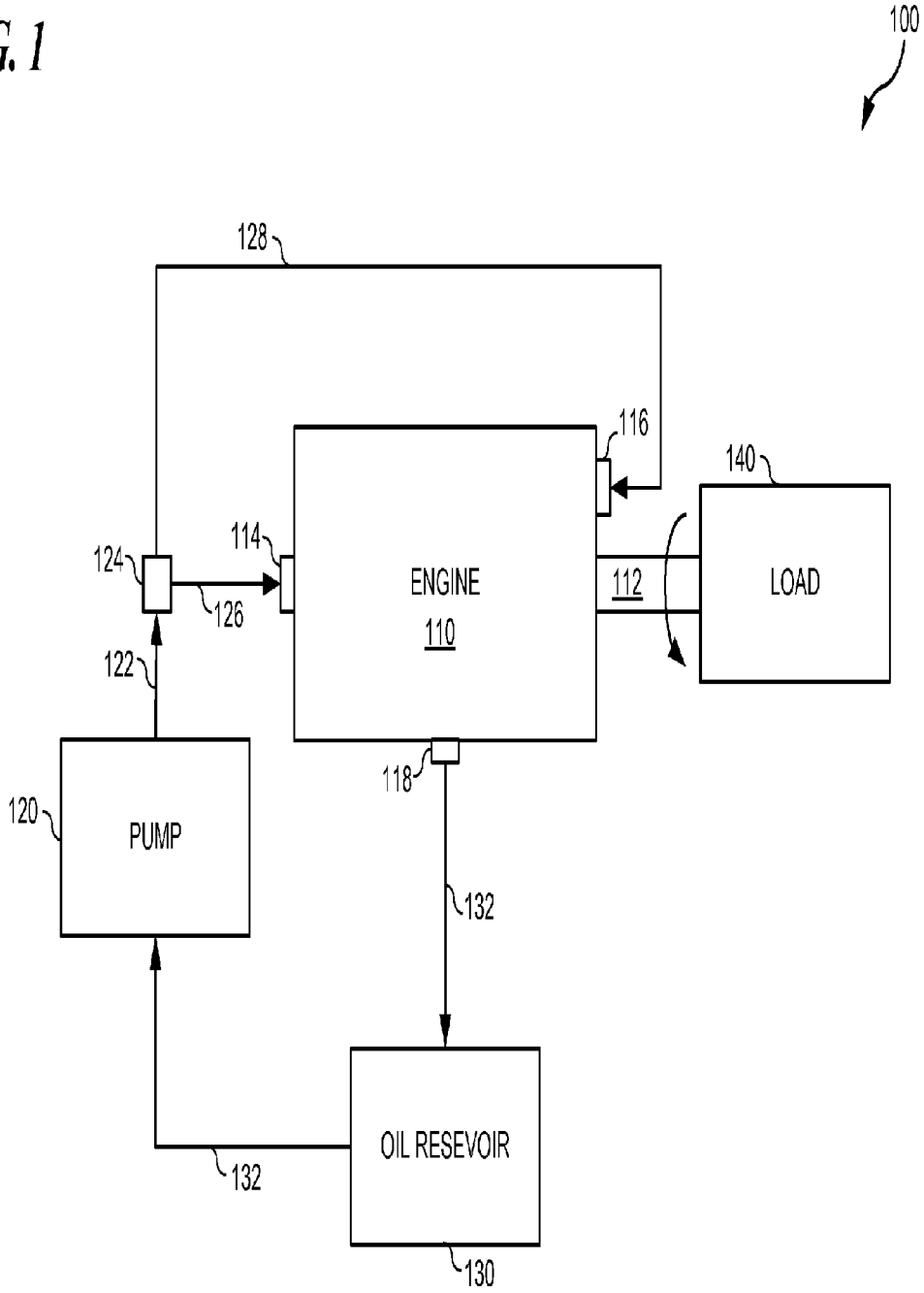
FIG. 1 illustrates a high-level block diagram showing a hydraulic engine system, which can be implemented in accordance with a preferred embodiment.

Referring now to the drawings, FIG. 1 illustrates a high-level block diagram of a hydraulic engine system 100. As shown, system 100 includes a hydraulic engine 110 configured to provide rotational energy to a load 140 through a drive shaft 112. In the illustrated embodiment, hydraulic engine 110 includes intake ports 114 and 116, which are configured to receive pressurized hydraulic fluid from a pump 120, as described in more detail below.

Pump 120 is an otherwise conventional pump, configured to provide pressurized hydraulic fluid. Pump 120 couples to an otherwise conventional conduit 122 configured to convey pressurized hydraulic fluid. Conduit 122 couples to an otherwise conventional valve 124, which couples to conduit 126 and conduit 128. Conduit 126 is an otherwise conventional conduit configured to convey pressurized hydraulic fluid and couples to intake port 114 of engine 110. Conduit 128 is an otherwise conventional conduit configured to convey pressurized hydraulic fluid and couples to intake port 116 of engine 110.

Engine 110 receives pressurized hydraulic fluid from pump 120 and generates rotational energy imparted to drive shaft 112. Engine 110 collects hydraulic fluid and is configured to provide hydraulic fluid though an outlet port 118. Port 118 is an otherwise conventional outlet configured to deliver hydraulic fluid. Port 118 couples to a reservoir 130.

Specifically, reservoir 130 is an otherwise conventional hydraulic fluid reservoir. Reservoir 130 couples to port 118 of engine 110 through conduit 132. Conduit 132 is an otherwise conventional conduit configured to convey pressurized hydraulic fluid. Reservoir 130 also couples to pump 120. Specifically, reservoir 130 couples to pump 120 through conduit 134. Conduit 132 is an otherwise conventional conduit configured to convey pressurized hydraulic fluid.

Figure 2:
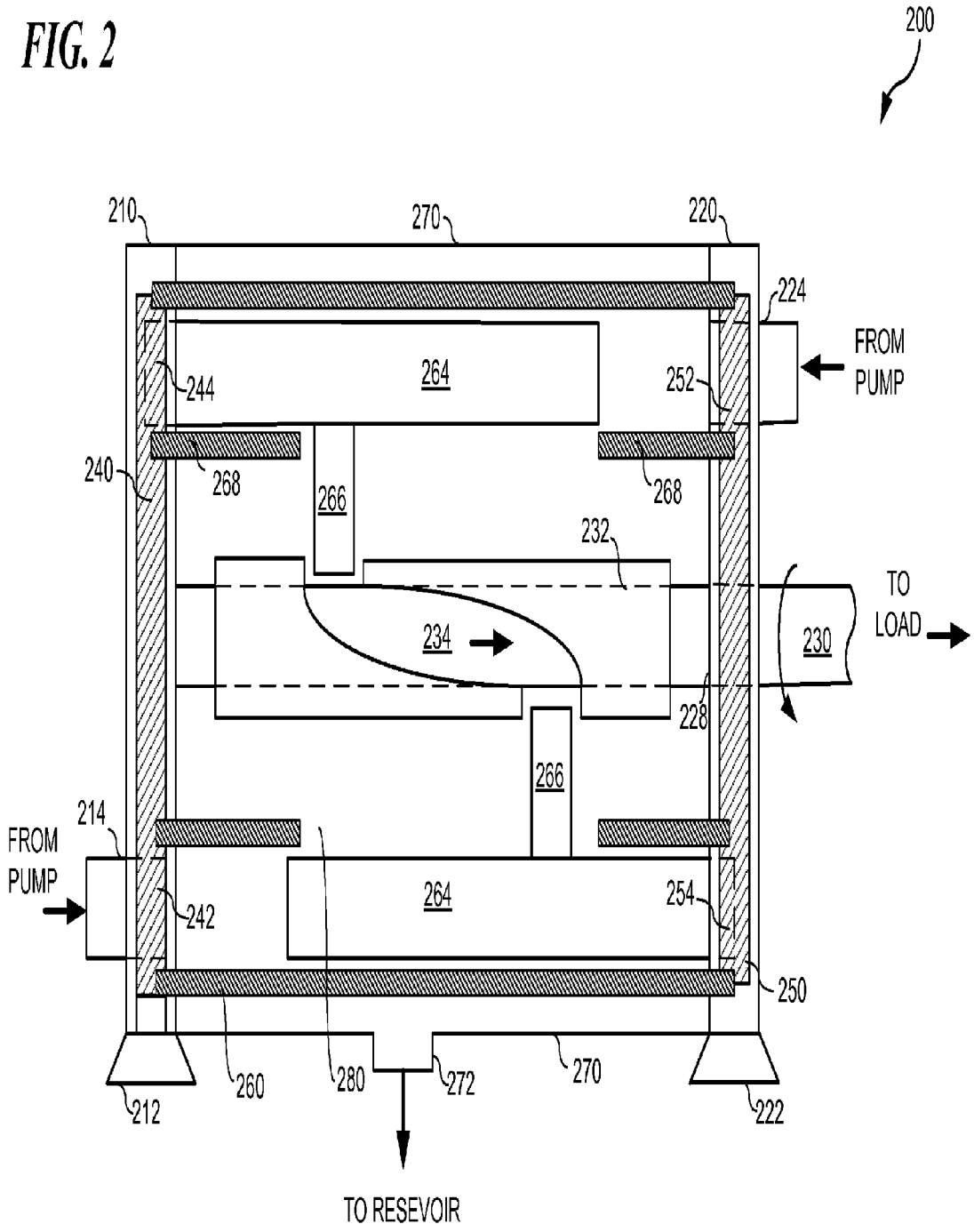
FIG. 2 illustrates a high-level block diagram showing a hydraulic engine, which can be implemented in accordance with a preferred embodiment.

FIG. 2 illustrates in additional detail a hydraulic engine 200 in one embodiment, such as engine 110 of FIG. 1, for example. Specifically, engine 200 includes a distribution wheel housing 210, a distribution wheel housing 220, a drive shaft 230, a distribution wheel 240, a distribution wheel 250, a piston cylinder 260, and a shell 270.

Generally, distribution wheel housing 210 defines an enclosure configured to envelop a distribution wheel, while maintaining freedom of rotation of the distribution wheel. In the illustrated embodiment, housing 210 includes a foot 212. Generally, foot 212 is an otherwise conventional support member and is configured to support and stabilize housing 210 relative to a support surface (not shown).

In the illustrated embodiment, housing 210 includes an intake port 214. Generally, port 214 is an otherwise conventional intake port, configured to receive pressurized hydraulic fluid from a pump, such as pump 120 of FIG. 1, for example. In the illustrated embodiment, housing 210 includes a shaft bushing 216. Generally, bushing 216 is an otherwise conventional bushing and is configured to receive and support a drive shaft, maintaining freedom of rotation of the drive shaft.

Similarly, distribution wheel housing 220 defines an enclosure configured to envelop a distribution wheel, while maintaining freedom of rotation of the distribution wheel. In the illustrated embodiment, housing 220 includes a foot 222. Generally, foot 222 is an otherwise conventional support member and is configured to support and stabilize housing 220 relative to a support surface (not shown).

In the illustrated embodiment, housing 220 includes an intake port 224. Generally, port 224 is an otherwise conventional intake port, configured to receive pressurized hydraulic fluid from a pump, such as pump 120 of FIG. 1, for example. In the illustrated embodiment, housing 220 includes a shaft bushing 226. Generally, bushing 226 is an otherwise conventional bushing and is configured to receive and support a drive shaft, maintaining freedom of rotation of the drive shaft. In the illustrated embodiment, housing 220 also includes a shaft bushing 228. Generally, bushing 228 is an otherwise conventional bushing and is configured to receive and support a drive shaft, maintaining freedom of rotation of the drive shaft.

System 200 includes drive shaft 230. In the illustrated embodiment, drive shaft 230 is an infinity drive, described in additional detail below. Generally, drive shaft 230 is configured to impart rotational torque to a load, such as load 140 of FIG. 1, for example. Specifically, shaft 320 includes a surface 232. Generally, surface 232 defines a drive groove 234. Drive groove 234 is configured to receive a drive pin and to direct force received from a drive pin into torque applied to rotate shaft 320, as described in more detail below.

System 200 includes a forward distribution wheel 240. Wheel 240 couples to shaft 230 and is configured to rotate axially with shaft 230, within housing 210. In the illustrated embodiment, wheel 240 includes an inlet aperture 242, configured to permit pressurized hydraulic fluid to pass through wheel 240. Wheel 240 also includes an exhaust aperture 244, configured as a groove configured to receive hydraulic fluid from a piston cylinder 260 and deposit received hydraulic fluid in an inner chamber 280.

Similarly, system 200 includes a rear distribution wheel 250. Wheel 250 couples to shaft 230 and is configured to rotate axially with shaft 230, within housing 220. In the illustrated embodiment, wheel 250 includes an inlet aperture 252, configured to permit pressurized hydraulic fluid to pass through wheel 250. Wheel 250 also includes an exhaust aperture 264, configured as a groove configured to receive hydraulic fluid from a piston cylinder 260 and deposit received hydraulic fluid in an inner chamber 280.

System 200 includes a plurality of piston cylinders 260. As described in more detail below, each piston cylinder 260 defines a cylinder aperture 262, through which is disposed a drive pin 266 of a piston 264. Generally, as described in more detail below, hydraulic fluid forces piston 264 back and forth within its piston cylinder 260. As piston 264 moves, drive pin 266 imparts force to drive groove 234, which causes shaft 230 to rotate. Generally, drive groove 234 defines the left limit and right limit of movement of a piston 264. In the illustrated embodiment, stops 268 also serve to limit movement of a piston 264. In one embodiment, system 200 includes four piston cylinders 260. In an alternate embodiment, system 200 includes six piston cylinders 260. One skilled in the art will understand that other suitable numbers of piston cylinders 260 can also be employed.

As described above, exhaust apertures 244 and 254 deposit hydraulic fluid into an inner chamber 280. Deposited fluid is dispersed throughout chamber 280 by the rotation of the distribution wheels. Deposited fluid coats and cools the internal components, and then drains into a lower (sump) portion of inner chamber 280. Generally, a shell or housing 270 encloses the internal components, forming inner chamber 280. In the illustrated embodiment, housing 270 includes a sump outlet 272. Generally, outlet 272 is configured to couple to a reservoir and to deliver hydraulic fluid to a reservoir. Additional details of the components of system 200 are described below.

Figure 3:
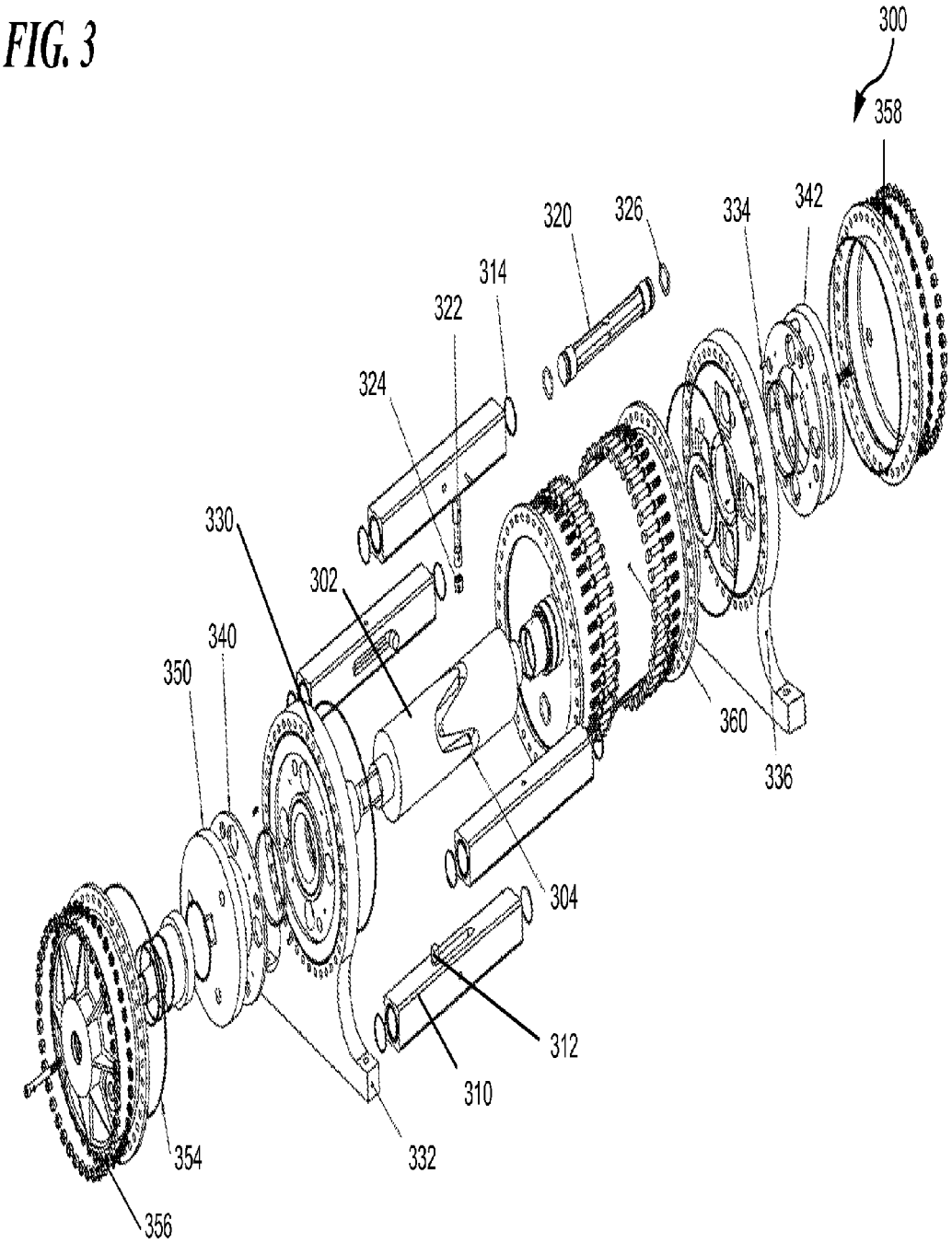
FIG. 3 illustrates an exploded view of certain components of a hydraulic engine, which can be implemented in accordance with a preferred embodiment.

FIG. 3 is an exploded diagram of an exemplary hydraulic engine system 300, in accordance with one embodiment. In the illustrated embodiment, system 300 includes an infinity drive shaft 302. As shown, drive shaft 302 includes a drive groove 304. In the illustrated embodiment, drive groove 304 forms a complete circuit around the axis of rotation of drive shaft 302. Generally, drive groove 304 is configured to receive a drive pin 322, as described in more detail below.

System 300 includes a plurality of piston cylinders 310. Generally, each piston cylinder 310 includes an aperture 312, configured to seat a drive pin 322. In the illustrated embodiment, one or more o-rings 314 couple to an end of cylinder 310, to assist in forming a seal when cylinder 310 couples to housing 330, as described below.

System 300 includes a plurality of pistons 320. Each piston 320 is configured to fit inside a corresponding cylinder 310, oriented such that an associated drive pin 322 seats within the aperture 312 of the cylinder 310. In the illustrated embodiment, drive pin 322 couples to a drive pin bearing 324. As such, in the illustrated embodiment, drive groove 304 is further configured to receive bearing 324.

Each cylinder 310 couples to a front housing 330 and a rear housing 334. Front housing 330 includes foot support 332 and rear housing 334 includes foot support 336. Generally, foot supports 332 and 336 are configured to stabilize upright housings 330 and 334 on the surface on which they stand. Generally, housing 330 and 334 are configured to support In the illustrated embodiment, a front distribution wheel 340 couples to a side of housing 330 such that wheel 340 is configured to rotate adjacent to housing 330. In an alternate embodiment, housing 330 is configured to envelop wheel 340 such that wheel 340 is configured to rotate within housing 330. Generally, wheel 340 is configured to permit pressurized hydraulic fluid to pass through one or more apertures, into one or more piston cylinders 310, as described in more detail below.

In the illustrated embodiment, wheel 340 also couples to drive shaft 302. Additionally, a cap plate 350 couples to wheel 340. In the illustrated embodiment, an intake manifold 354 couples to cap plate 350 and housing 330. In the illustrated embodiment, a plurality of bolts 356 secure manifold 354 to housing 330. Generally, manifold 354 is configured to receive pressurized hydraulic fluid and to deliver pressurized hydraulic fluid to wheel 340.

Similarly, in the illustrated embodiment, a rear distribution wheel 342 couples to housing 334 such that wheel 342 is configured to rotate adjacent to housing 334. In an alternate embodiment, housing 334 is configured to envelop wheel 342 such that wheel 342 is configured to rotate within housing 334. Generally, wheel 342 is configured to permit pressurized hydraulic fluid to pass through one or more apertures, into one or more piston cylinders 310, as described in more detail below.

In the illustrated embodiment, wheel 342 also couples to drive shaft 302. Additionally, in the illustrated embodiment, an intake manifold 358 couples to housing 334, enclosing wheel 342. In the illustrated embodiment, a plurality of bolts 356 secure manifold 358 to housing 334. Generally, manifold 358 is configured to receive pressurized hydraulic fluid and to deliver pressurized hydraulic fluid to wheel 342.

System 300 also includes a shell 360. Generally, shell 360 encloses the piston cylinders 310 and drive shaft 302. Additionally, in one embodiment, shell 360 receives exhaust hydraulic fluid, lubricates piston cylinders 310, pistons 320, and drive shaft 302. In one embodiment, shell 360 is configured to deliver hydraulic fluid to a sump and/or reservoir (not shown). Additional operational details and component features are described below.

Figure 4:
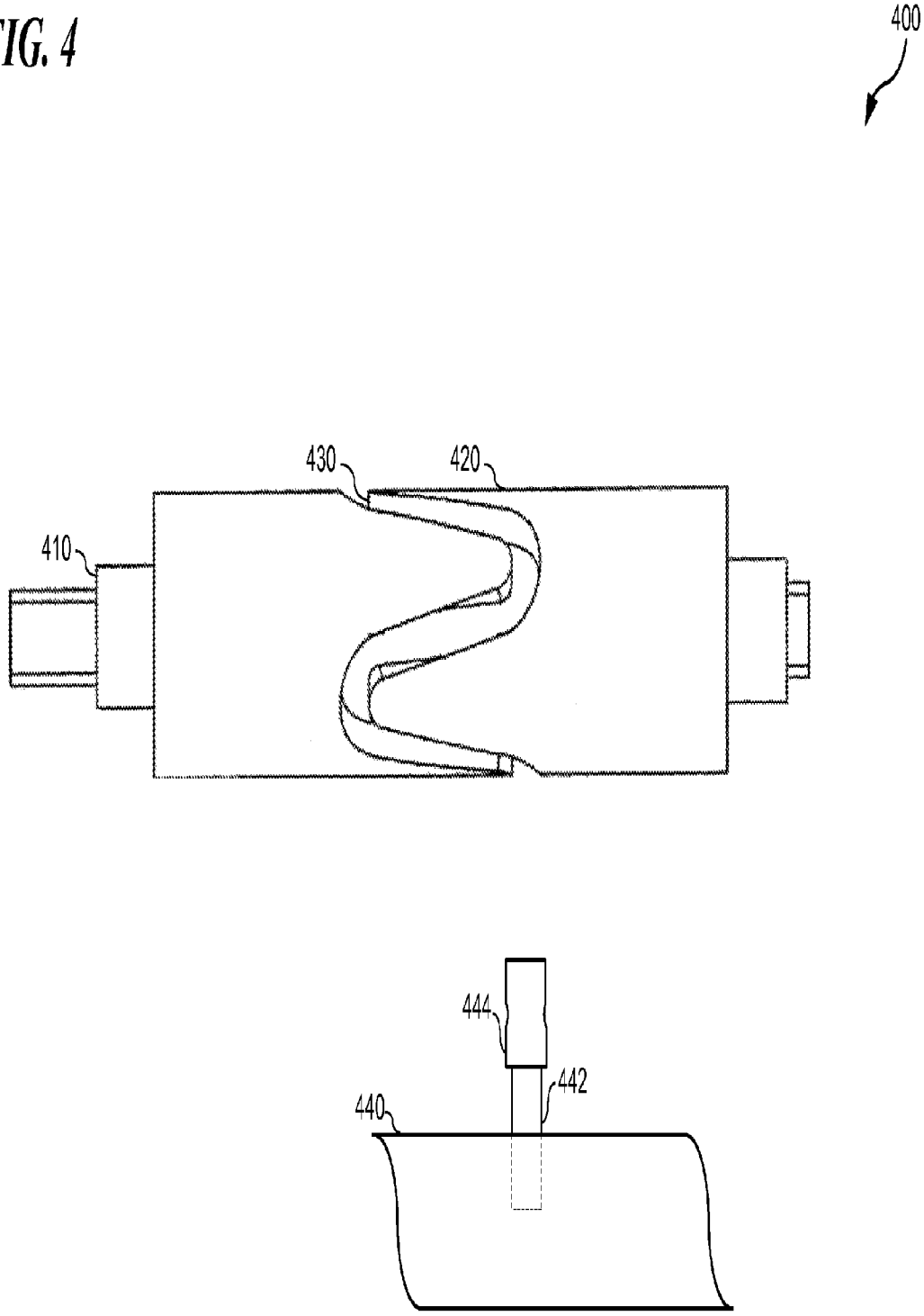
FIG. 4 illustrates an exemplary infinity drive, which can be implemented in accordance with a preferred embodiment.

FIG. 4 illustrates and exemplary drive shaft in one embodiment. Specifically, drive shaft 400 includes a load shaft 410. Generally, load shaft 410 is an otherwise conventional shaft configured to impart rotational energy to a load. In the illustrated embodiment, load shaft 410 is depicted as a solid shaft. In an alternate embodiment, load shaft 410 couples to a load through one or more bearings and/or couplings.

Shaft 400 also includes a surface 420. In the illustrated embodiment, surface 420 is a raised or thickened portion of load shaft 410. In one embodiment, surface 420 is a solid block of metal, out of which load shaft 410 has been machined or otherwise etched. In an alternate embodiment, surface 420 is coupled to load shaft 410.

As illustrated, surface 420 defines a drive groove 430. Generally, groove 430 is a continuous recessed portion of surface 420, forming a complete circuit around and axis of load shaft 410. In one embodiment, groove 430 is configured to define a continuous cam pattern. In one embodiment, a continuous cam pattern is a pattern in which a drive pin fixed in one plane and travelling along the groove, would project a sine wave onto a plane parallel to the drive shaft and onto a plane parallel to the plane in which the drive pin is fixed.

FIG. 4 also illustrates and exemplary segment of a piston shaft 440, in accordance with one embodiment. Generally, piston shaft 440 couples to a drive pin 442. In one embodiment, drive pin 442 is configured to seat within groove 430. In one embodiment, drive pin 442 couples to drive bearing 444. Generally, drive bearing 444 is configured to mount to drive pin 442 and to provide reduced lateral friction as pin 442 travels within groove 430.

Figure 5:
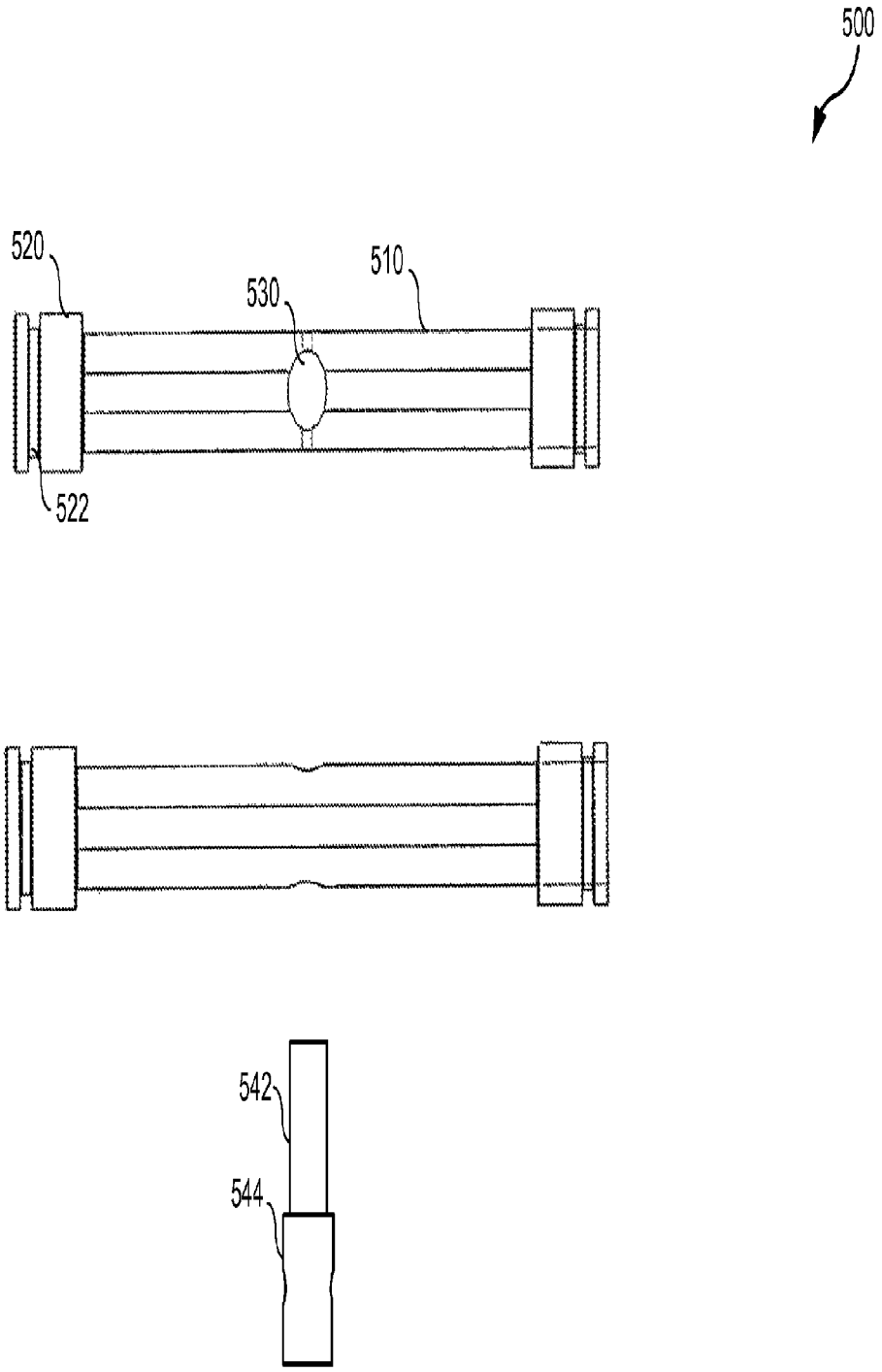
FIG. 5 illustrates an exemplary drive piston, which can be implemented in accordance with a preferred embodiment.

FIG. 5 illustrates an exemplary piston 500, in accordance with one embodiment. In one embodiment, piston 500 includes a piston shaft 510. In the illustrated embodiment, piston 500 also includes a end cap 520 at each end of shaft 510. Generally, each end cap 520 is configured to receive force from pressurized hydraulic fluid, and to transmit received force to shaft 510, thereby moving shaft 510 axially within a piston cylinder (not shown). In one embodiment, end cap 520 includes a groove 522. In one embodiment, groove 522 is configured to receive an o-ring, gasket, or other suitable coupling.

Shaft 510 also includes a pin port 530. Generally, pin port 530 is configured to receive a drive pin 542. In one embodiment, pin port 530 is a recessed segment into a solid shaft 510. In an alternate embodiment, pin port 530 is an aperture into a hollow shaft 510. Drive pin 542 is a drive pin as described herein. In the illustrated embodiment, drive pin 542 couples to a drive bearing 544, as described herein.

Figure 6:
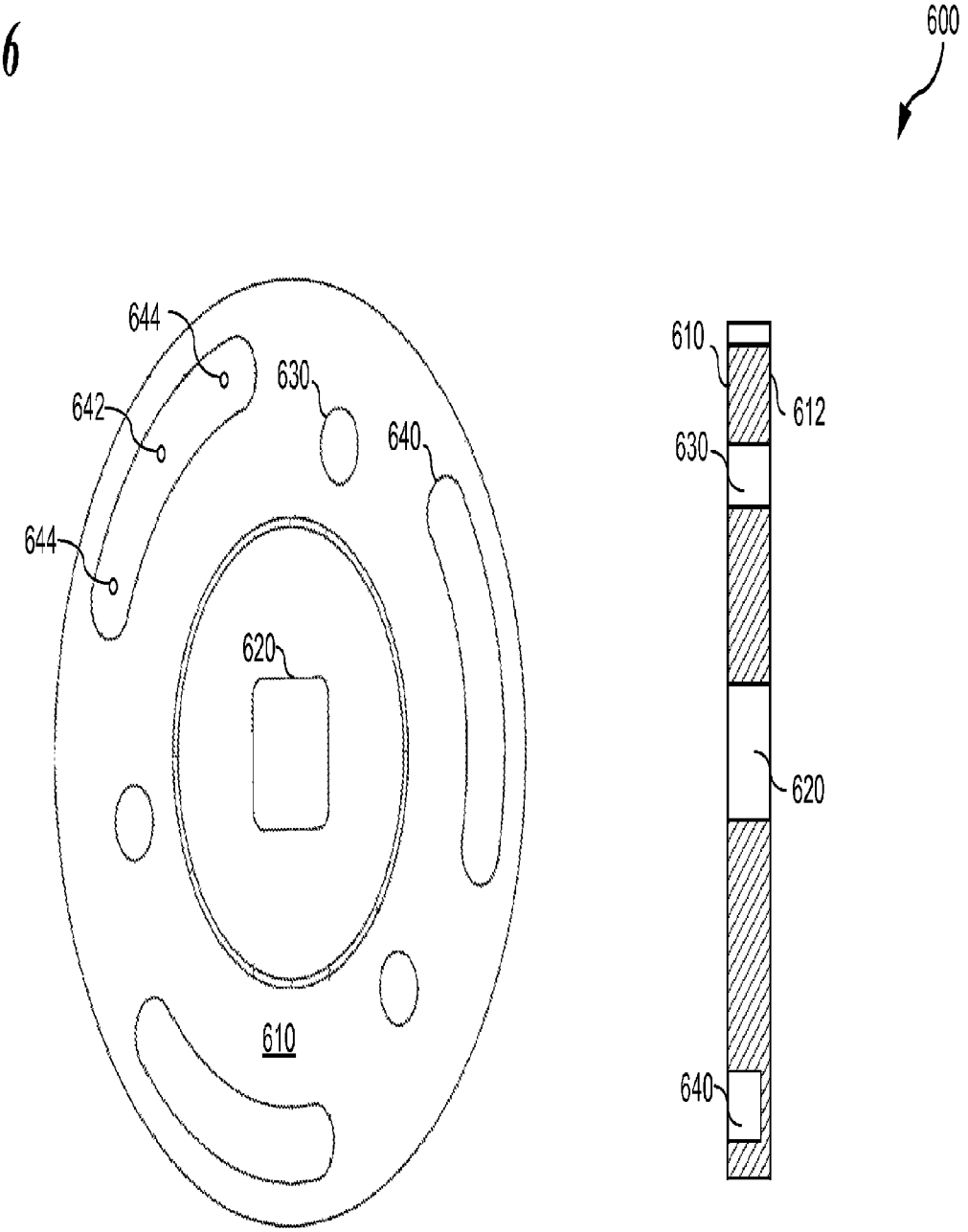
FIG. 6 illustrates an exemplary distribution wheel, which can be implemented in accordance with a preferred embodiment.

FIG. 6 illustrates an exemplary forward distribution wheel 600, in accordance with one embodiment. In the illustrated embodiment, wheel 600 includes a first face 610 and a second face 612. Generally, face 610 is oriented "inward" or toward the drive shaft of the system in which wheel 600 is installed. Generally, face 612 is oriented "outward" or toward the intake port of the housing in which wheel 600 is installed. One skilled in the art will understand that the planes defined by faces 610 and 612 are configured substantially perpendicular to the axis of rotation of the drive shaft of the system in which wheel 600 is installed.

In the illustrated embodiment, wheel 600 includes aperture 620. Generally, aperture 620 is configured to couple to a drive shaft. In one embodiment, aperture 620 is configured to rotate wheel 600 around the axis of a drive shaft, as the drive shaft rotates.

In the illustrated embodiment, wheel 600 includes a plurality of intake apertures 630. Generally, apertures 630 are configured to allow pressurized hydraulic fluid to pass through wheel 600, from face 612 to face 610. In the illustrated embodiment, wheel 600 includes three apertures 630. In an alternate embodiment, wheel 600 can be configured to include any number of apertures 630 suitable to attain the desired performance of the system. In one embodiment, each aperture 630 is disposed equidistant from a neighboring aperture 630.

In the illustrated embodiment, wheel 600 includes a plurality of outlet apertures 640. In the illustrated embodiment, apertures 640 are configured to receive hydraulic fluid along a groove, and to prevent fluid from passing through wheel 600 from face 610 to face 612. In the illustrated embodiment, wheel 600 includes three apertures 640. In an alternate embodiment, wheel 600 can be configured to include any number of apertures 640 suitable to attain the desired performance of the system. In one embodiment, each aperture 640 is disposed equidistant from a neighboring aperture 640.

In the illustrated embodiment, wheel 600 is configured with an equal number of apertures 630 and apertures 640. In the illustrated embodiment, each aperture 640 is configured as a groove, and is disposed radially opposite from a corresponding aperture 630. In the illustrated embodiment, aperture 630 is disposed radially opposite from a center point 642 of an aperture 640. In an alternate embodiment, aperture 630 is disposed radially opposite from an end point 644 of an aperture 640.

In operation, as described in more detail below, pressurized hydraulic fluid passes through aperture 630 from face 610 to face 610 and into a piston cylinder (not shown). Similarly, in one embodiment, pressurized hydraulic fluid passes from a piston cylinder (not shown) into groove 640, running along face 610 into an inner chamber housing the drive shaft to which wheel 600 couples. The operation of the forward distribution wheel 600 in conjunction with a piston and piston cylinder is described in more detail below, with respect to FIGS. 8-12.

Figure 7:
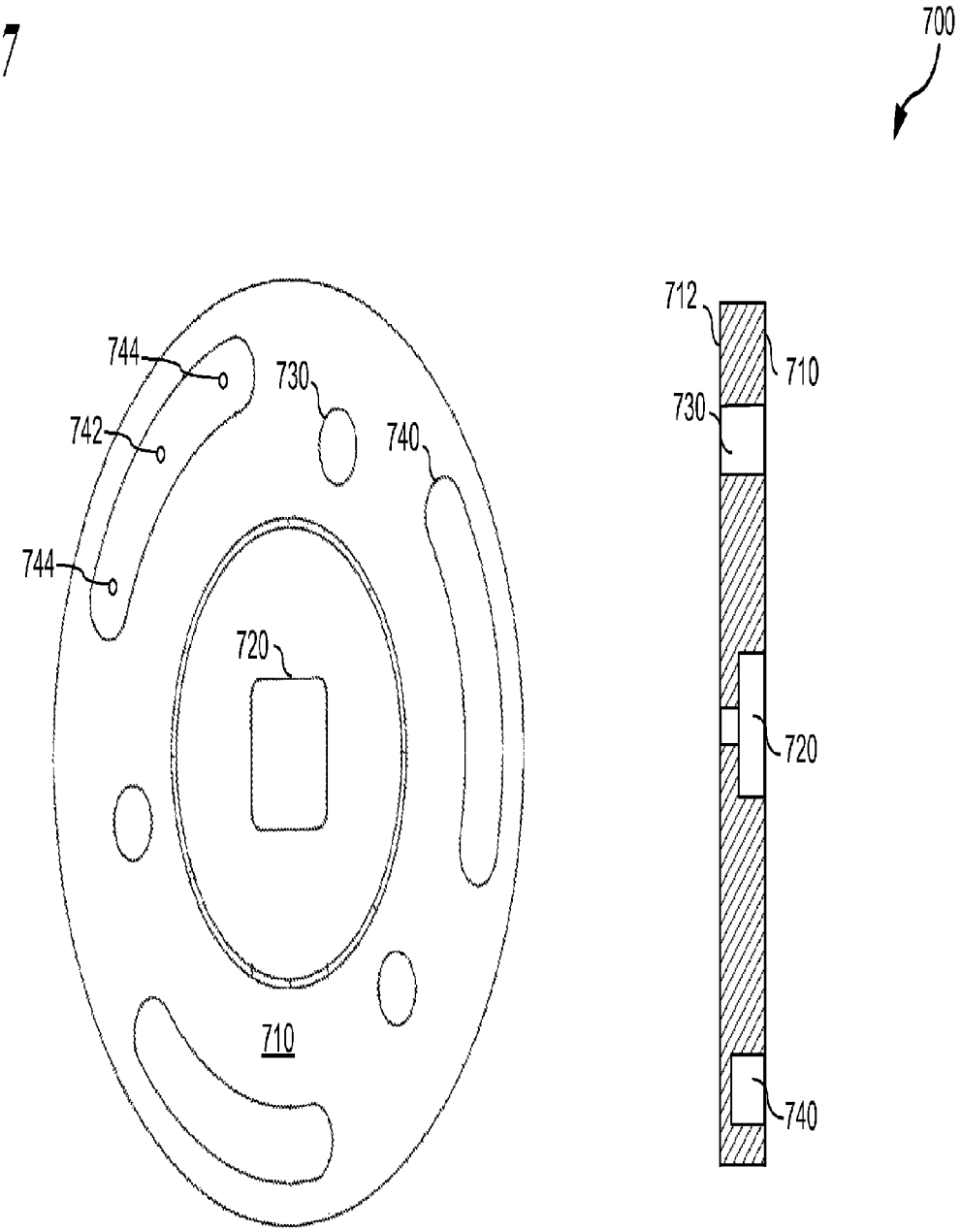
FIG. 7 illustrates an exemplary distribution wheel, which can be implemented in accordance with a preferred embodiment.

FIG. 7 illustrates an exemplary rear distribution wheel 700, in accordance with one embodiment. In the illustrated embodiment, wheel 700 includes a first face 710 and a second face 712. Generally, face 710 is oriented "inward" or toward the drive shaft of the system in which wheel 700 is installed. Generally, face 712 is oriented "outward" or toward the intake port of the housing in which wheel 700 is installed. One skilled in the art will understand that the planes defined by faces 710 and 712 are configured substantially perpendicular to the axis of rotation of the drive shaft of the system in which wheel 700 is installed.

In the illustrated embodiment, wheel 700 includes aperture 720. Generally, aperture 720 is configured to couple to a drive shaft. In one embodiment, aperture 720 is configured to rotate wheel 700 around the axis of a drive shaft, as the drive shaft rotates.

In the illustrated embodiment, wheel 700 includes a plurality of intake apertures 730. Generally, apertures 730 are configured to allow pressurized hydraulic fluid to pass through wheel 700, from face 712 to face 710. In the illustrated embodiment, wheel 700 includes three apertures 730. In an alternate embodiment, wheel 700 can be configured to include any number of apertures 730 suitable to attain the desired performance of the system. In one embodiment, each aperture 730 is disposed equidistant from a neighboring aperture 730.

In the illustrated embodiment, wheel 700 includes a plurality of outlet apertures 740. In the illustrated embodiment, apertures 740 are configured to receive hydraulic fluid along a groove, and to prevent fluid from passing through wheel 700 from face 710 to face 712. In the illustrated embodiment, wheel 700 includes three apertures 740. In an alternate embodiment, wheel 700 can be configured to include any number of apertures 740 suitable to attain the desired performance of the system. In one embodiment, each aperture 740 is disposed equidistant from a neighboring aperture 740.

In the illustrated embodiment, wheel 700 is configured with an equal number of apertures 730 and apertures 740. In the illustrated embodiment, each aperture 740 is configured as a groove, and is disposed radially opposite from a corresponding aperture 730. In the illustrated embodiment, aperture 730 is disposed radially opposite from a center point 742 of an aperture 740. In an alternate embodiment, aperture 730 is disposed radially opposite from an end point 744 of an aperture 740.

In operation, as described in more detail below, pressurized hydraulic fluid passes through aperture 730 from face 710 to face 710 and into a piston cylinder (not shown). Similarly, in one embodiment, pressurized hydraulic fluid passes from a piston cylinder (not shown) into groove 740, running along face 710 into an inner chamber housing the drive shaft to which wheel 700 couples. The operation of the forward distribution wheel 700 in conjunction with a piston and piston cylinder is described in more detail below, with respect to FIGS. 8-12.

FIGS. 8-12 illustrate operation of a hydraulic engine in one embodiment, in an exemplary operation. For simplification, each of FIGS. 8-12 omit many components in order to emphasize certain features. Additionally, the features represented in each of FIGS. 8-12 are depicted in symbolic form, in order to highlight the relative orientation of each component to other components in various points in a single rotation of the drive shaft.

Figure 8:
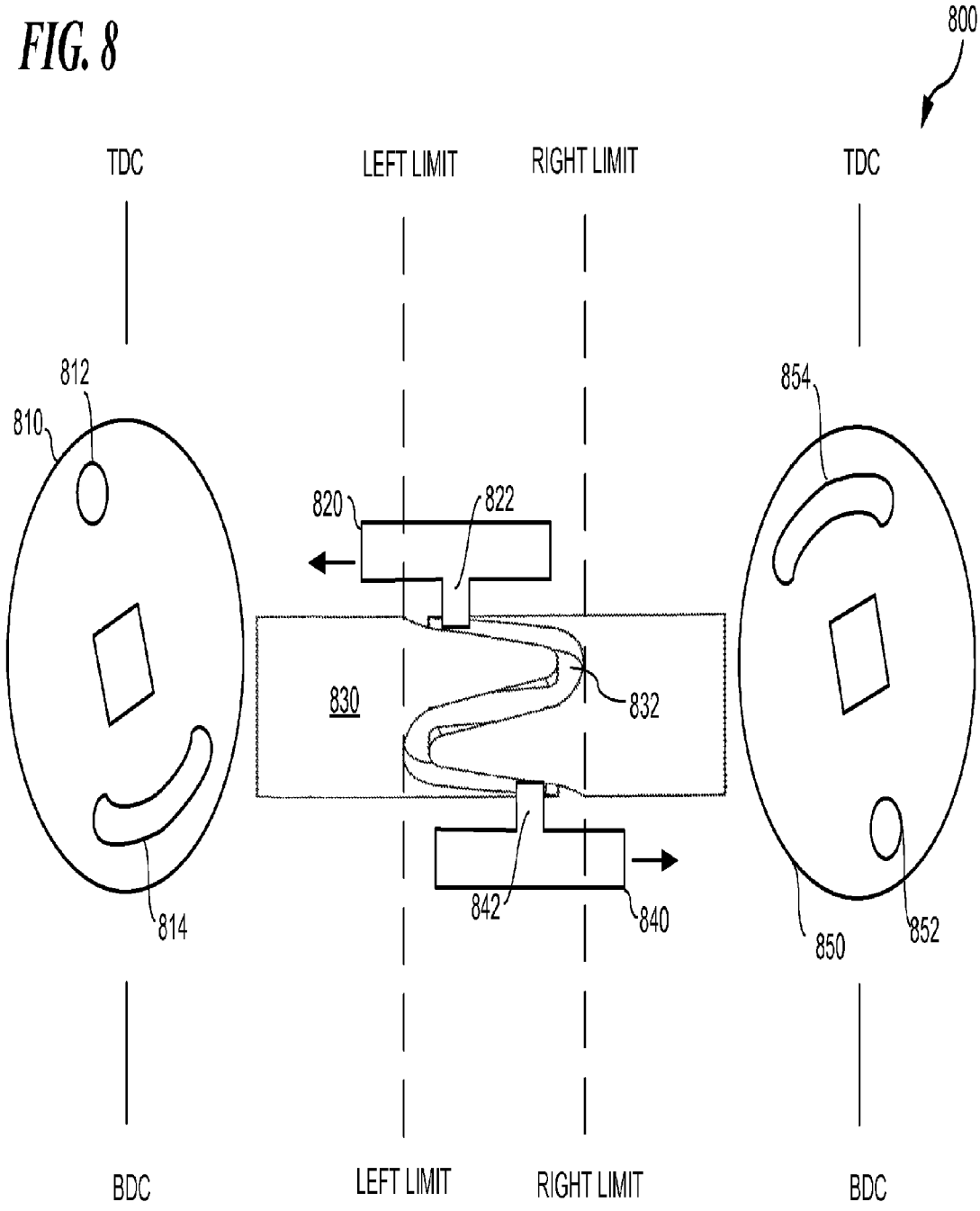
FIGS. 8-12 illustrates a series of conceptual diagrams showing an exemplary operation of a hydraulic engine, which can be implemented in accordance with a preferred embodiment.

For example, FIG. 8 illustrates a symbolic view of various components of a system 800, representing internal components of a hydraulic engine as described herein. As shown, a front distribution wheel 810 is oriented with an intake aperture 812 at top dead center (TDC). In the illustrated embodiments, TDC represents alignment with an upper piston cylinder (not shown). Specifically, the upper piston cylinder houses upper piston 820. As shown, front distribution wheel 810 is also oriented with an exhaust aperture 814 oriented with a groove end at bottom dead center (BDC). In the illustrated embodiments, BDC represents alignment with a lower piston cylinder (not shown). Specifically, the lower piston cylinder houses lower piston 840.

Upper piston 820 includes a drive pin 822, which is shown inserted in a drive groove 832 of drive shaft 830. Similarly, a lower piston 840 includes a drive pin 842, which is shown inserted in drive groove 832. Generally, pressurized hydraulic fluid pushes pistons 820 and 840 back and forth within their respective cylinders, between their left limit and right limit. As each piston moves, the piston drive pin imparts force along groove 832, causing drive shaft 830 to rotate about its axis. As described in more detail in the following figures, the rotation of the distribution wheels controls the timing and movement of the pistons, thereby also determining the performance characteristics of the drive shaft.

System 800 also includes a rear distribution wheel 850. As shown, rear distribution wheel 850 is oriented with an intake aperture 852 at BDC. As shown, rear distribution wheel 850 is also oriented with an exhaust aperture 854 oriented with a groove end at TDC. Generally, whenever intake aperture 812 is at TDC or BDC, some portion of exhaust aperture 854 is also at the same point (TDC/BDC). Similarly, whenever intake aperture 852 is at TDC or BDC, some portion of exhaust aperture 814 is also at the same point (TDC/BDC). Generally, fluid enters a piston chamber on one side when an intake aperture (812 or 852) aligns with the piston chamber. Likewise, the fluid entering the piston chamber displaces the piston, which in turn displaces the fluid on the opposite side of the piston. The displaced fluid flows out through an exhaust aperture (854 or 814), into the drive shaft chamber. In the embodiment illustrated in FIG. 8, the upper piston 820 is near and moving toward its left limit, and lower piston 840 is near and moving toward its right limit.

Figure 9:
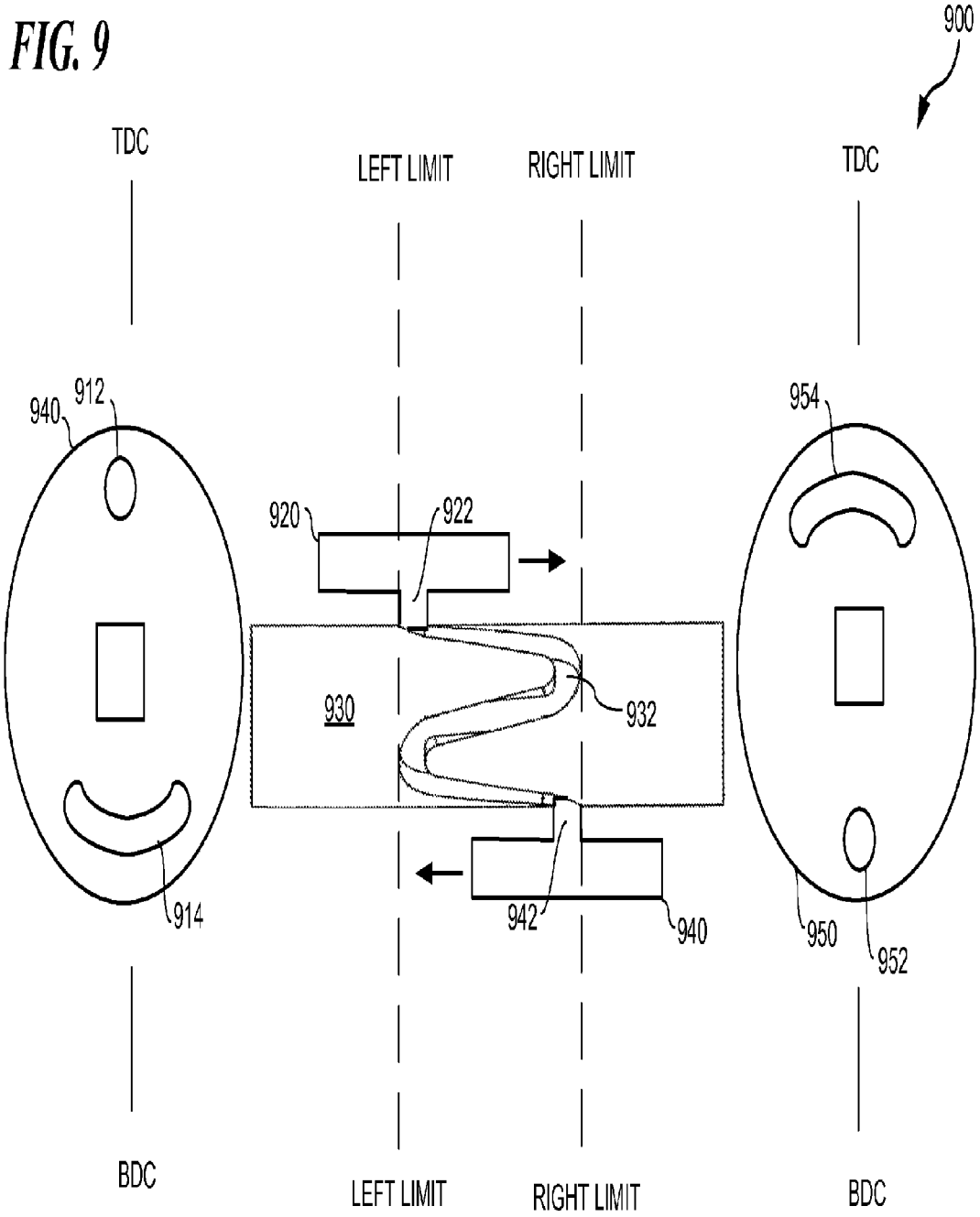

FIG. 9 illustrates a symbolic view of various components of a system 900, representing internal components of a hydraulic engine as described herein. Specifically, FIG. 9 includes a front distribution wheel 910, upper piston 920, drive shaft 930, lower piston 940, and rear distribution wheel 950. In the illustrated embodiment, upper piston 920 is shown at its left limit and lower piston 940 is shown at its right limit.

Figure 10:
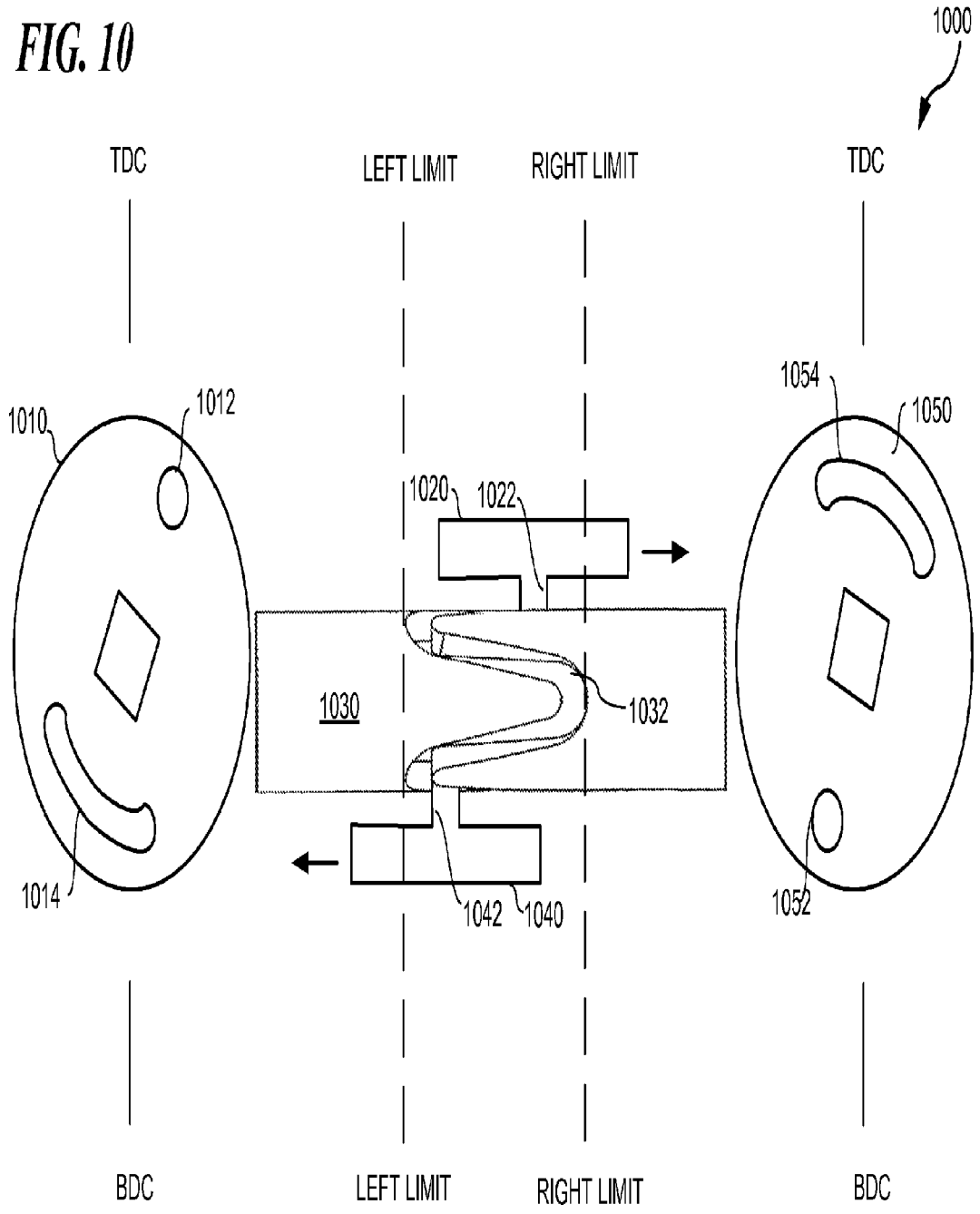

FIG. 10 illustrates a symbolic view of various components of a system 1000, representing internal components of a hydraulic engine as described herein. Specifically, FIG. 10 includes a front distribution wheel 1010, upper piston 1020, drive shaft 1030, lower piston 1040, and rear distribution wheel 1050. In the illustrated embodiment, upper piston 1020 is approaching its right limit and lower piston 1040 is approaching its left limit.

Figure 11:
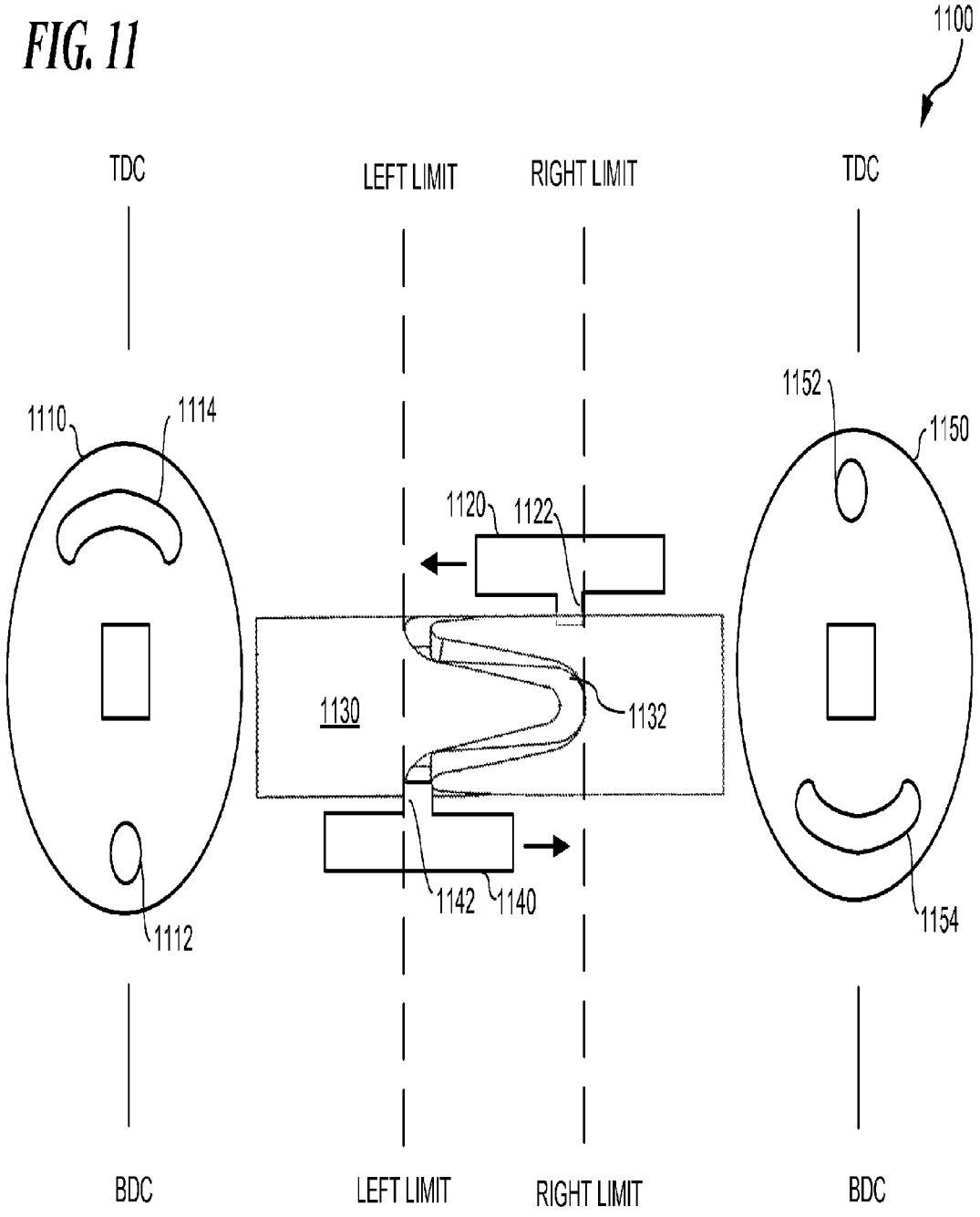

FIG. 11 illustrates a symbolic view of various components of a system 1100, representing internal components of a hydraulic engine as described herein. Specifically, FIG. 11 includes a front distribution wheel 1110, upper piston 1120, drive shaft 1130, lower piston 1140, and rear distribution wheel 1150. In the illustrated embodiment, upper piston 1120 is at its right limit and lower piston 1140 is at its left limit.

Figure 12:
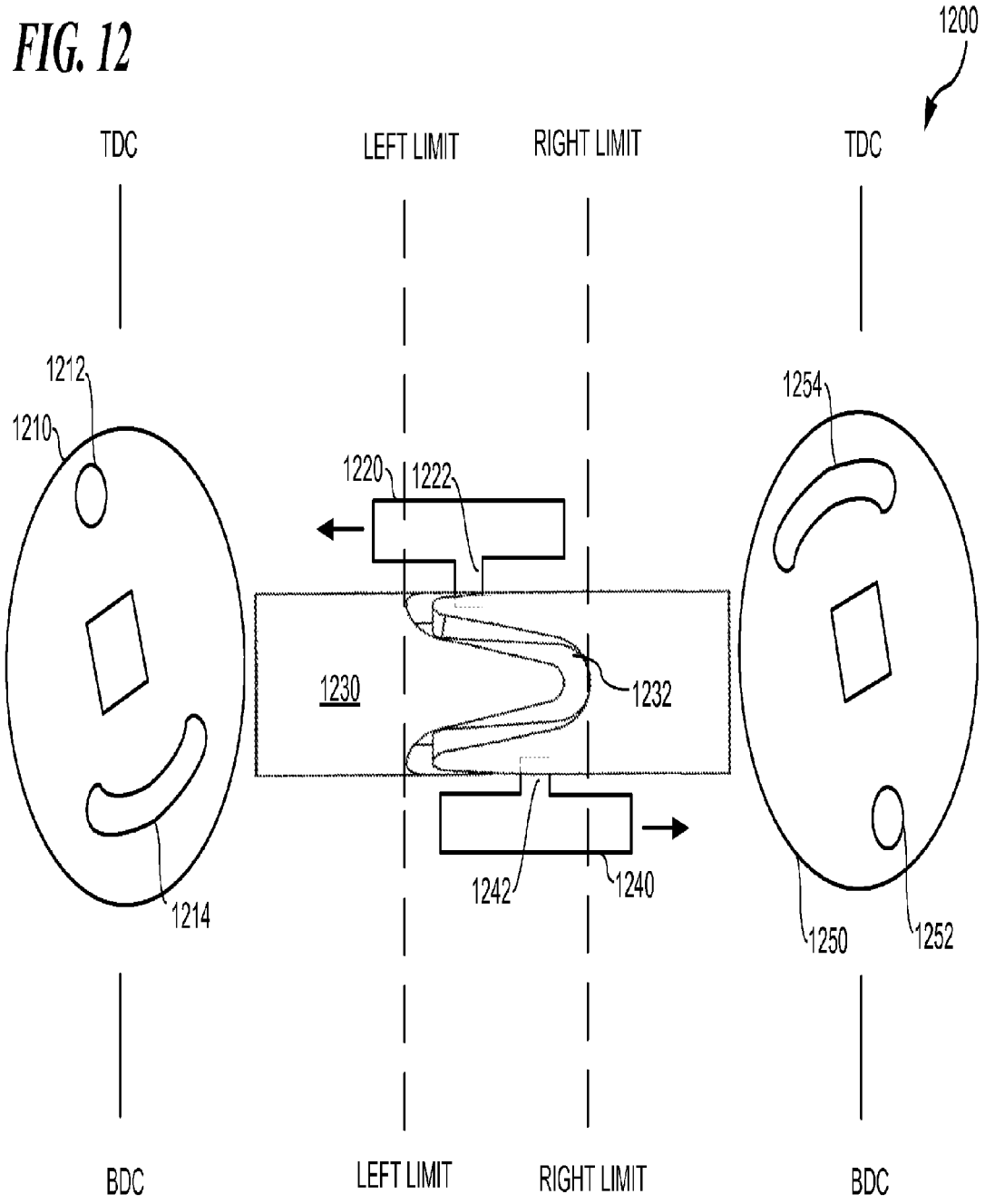

FIG. 12 illustrates a symbolic view of various components of a system 1200, representing internal components of a hydraulic engine as described herein. Specifically, FIG. 12 includes a front distribution wheel 1210, upper piston 1220, drive shaft 1230, lower piston 1240, and rear distribution wheel 1250. In the illustrated embodiment, upper piston 1220 is moving back toward its left limit and lower piston 1240 is moving back toward its right limit.

Figure 13A:
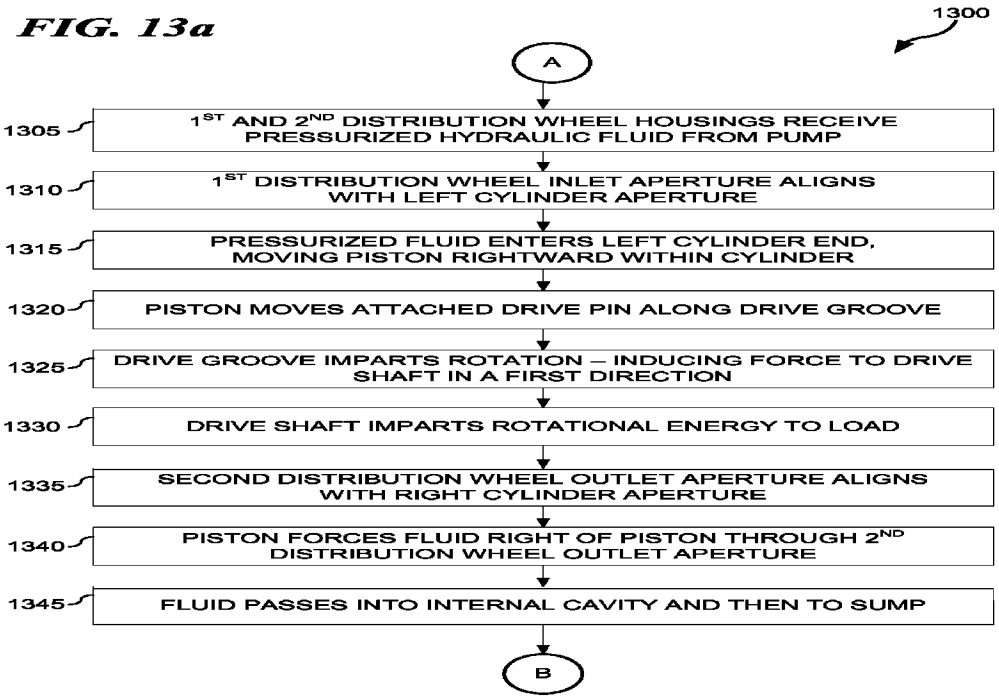
FIGS. 13A and 13B are flow diagrams illustrating an exemplary hydraulic engine method, which can be implemented in accordance with a preferred embodiment.
Figure 13B:
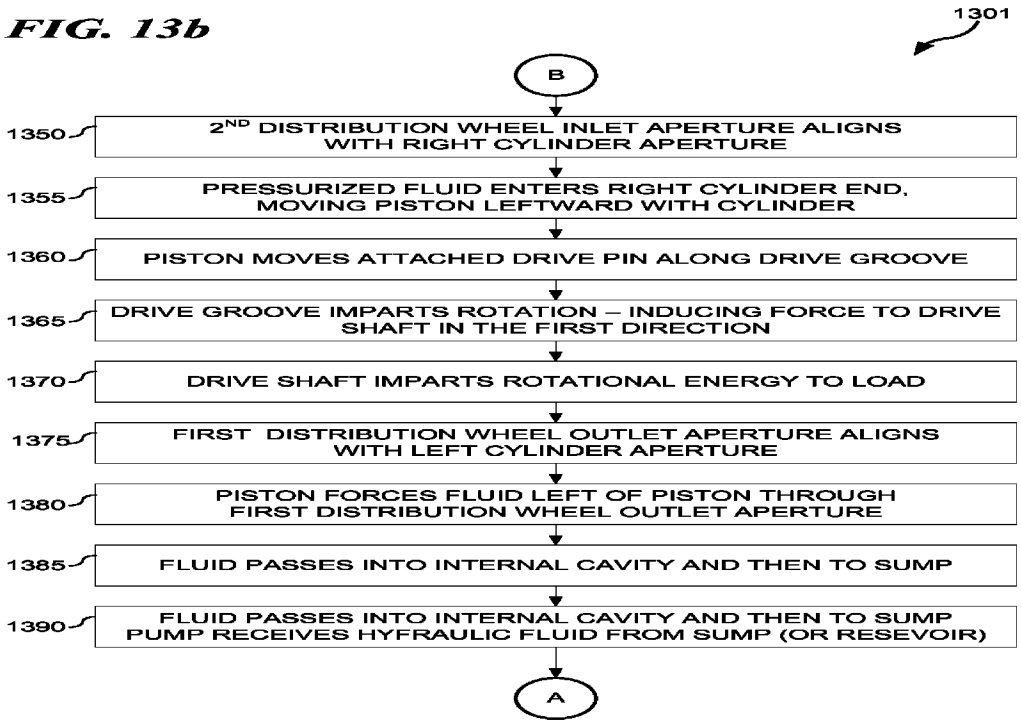

FIGS. 13A and 13B illustrate a flow diagram depicting a hydraulic engine method in accordance with one embodiment. Generally, FIGS. 13A and 13B depict an approximate order of operation and interaction of various components of a system employing a hydraulic engine as disclosed herein. One skilled in the art will understand that some events described can occur concurrently and/or in an order other than the exact order described with respect to FIGS. 13A and 13B.

FIG. 13A depicts a flow diagram 1300. Generally, the process begins at Marker "A" and moves to block 1305. As illustrated at block 1305, the first and second distribution wheels receive pressurized hydraulic fluid from a pump. Next, as illustrated at block 1310, the first distribution wheel inlet aperture aligns with the left aperture of a piston cylinder. Next as illustrated at block 1315, pressurized hydraulic fluid enters the left cylinder end, moving the piston rightward within the piston cylinder.

Next, as illustrated at block 1320, the piston moves its attached drive pin along the drive groove of a drive shaft. Next, as illustrated at block 1325, the drive groove imparts rotation-inducing force to the drive shaft in a first direction. Next, as illustrated at block 1330, the drive shaft imparts rotational energy to a load.

Next, as illustrated at block 1335, the second distribution wheel outlet aperture aligns with the right aperture of the piston cylinder. Next, as illustrated at block 1340, the piston forces hydraulic fluid to the right of the piston through the second distribution wheel outlet aperture. Next, as illustrated at block 1345, hydraulic fluid passes into an internal cavity of the hydraulic engine, lubricating and cooling the internal components, and then passing into a sump. The process continues to Marker "B" of FIG. 13B.

FIG. 13B depicts a flow diagram 1301. Generally, the process begins at Marker "B" and moves to block 1350. As illustrated at block 1350, the second distribution wheel inlet aperture aligns with the right cylinder aperture. Next, as illustrated at block 1355, pressurized hydraulic fluid enters the right cylinder end, moving the piston leftward within the piston cylinder. Next, as illustrated at block 1360, the piston moves its attached drive pin leftward along the drive groove.

Next, as illustrated at block 1365, the drive groove imparts rotation-inducing force to the drive shaft in the first direction. Next, as illustrated at block 1370, the drive shaft imparts rotational energy to a load. Next, as illustrated at block 1375, the first distribution wheel outlet aperture aligns with the left aperture of the piston cylinder. Next, as illustrated at block 1380, the piston forces hydraulic fluid to the left of the piston through the first distribution wheel outlet aperture.

Next, as illustrated at block 1385, hydraulic fluid passes into an internal cavity of the hydraulic engine, lubricating and cooling the internal components, and then passing into a sump. Next, as illustrated at block 1390, the pump receives hydraulic fluid from the sump, or a reservoir coupled to the sump. The process returns to Marker "A" of FIG. 13A.

Figure 14:
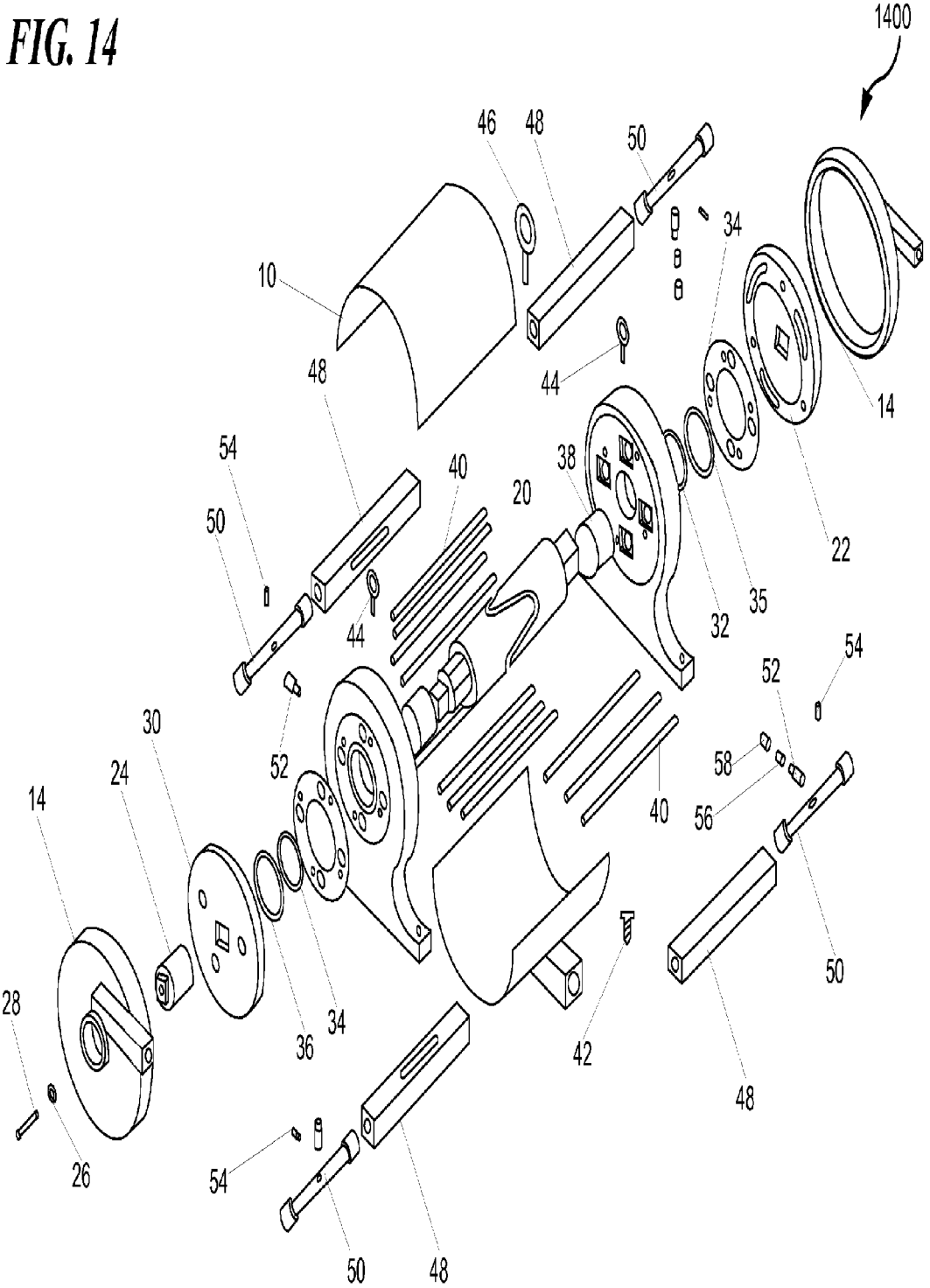
FIG. 14 illustrates an exploded view of certain components of a hydraulic engine, which can be implemented in accordance with a preferred embodiment.

FIG. 14 depicts an exploded view of a hydraulic engine system 1400 in accordance with one embodiment. In the illustrated embodiment, system 1400 includes a Top Infinity Shroud 10, a Bottom Infinity Shroud 12, a Forward Manifold for Infinity Housing 14, an Aft manifold for Infinity Housing 16, and an Infinity Housing 18. System 1400 also includes an Infinity drive 20, a Distribution Wheel 22, an Infinity Drive Extension 24, a Distribution Wheel Washer 26, a Distribution Wheel Bolt 28, and an Aft Distribution Wheel 30.\

System 1400 also includes Infinity Housing Bearings 32, an Infinity Housing Seal 34, an Infinity Housing to Distribution Wheel Seal 36, an Infinity Housing to Infinity Drive Bearings 38, a plurality of Infinity Drive Support Poles 40, and a plurality of Infinity Drive Support Pole Screw 42. System 1400 also includes a plurality of Manifold and Shroud Bolts 44, a Mounting Ring 46, and a Cylinder 48.

System 1400 also includes a Piston 50, a Piston Drive Pin 52, a Piston Pin 54, a plurality of Bearings for Piston Drive Pin Cap 56, and a plurality of Piston Drive Pin Caps 58. System 1400 also includes a Piston O-Ring 60 and an Aft Manifold for Infinity Housing Seal 62.

In one embodiment, system 1400 can be assembled as follows. Start with a long round grooved Infinity Drive 20 and slide an Infinity Housing Bearing 32 onto each end of the Infinity Drive 20. Next, install an Infinity Housing to Infinity Drive Bearing 38 onto each end. Next, slide a round shaped with feet Infinity Housing 18 with the square holes facing the Infinity Drive 20 onto one side of the Infinity Drive 20. Set aside.

Next, start with an O-Ring 60 and install onto each end of a barbell shaped Piston 50. Next, assemble a long rectangle Cylinder 48 with a Piston 50. Insert the Piston 50 into the Cylinder 48 half way so that the holes on the side line up. Insert a round Piston Drive Pin 52 into the Piston 50. Screw a Piston Pin 54 through the hole fastening the Piston 50 to the Piston Drive Pin 52. Insert a Bearings for Piston Drive Pin 56 into the Piston Drive Pin Cap 58. Next, slide onto the Piston Drive Pin 52. Do this for required number of cylinders needed in engine.

Next, slide cylinder assembly into the square hole in the Infinity Housing 18 moving the piston so that the Piston Drive Pin 52 is inserted into the groove of the Infinity Drive 20. Do this with each cylinder assembly.

Next, insert a round Infinity Drive Support Pole 40 into each of the round holes in the Infinity Housing 18. Slide a second Infinity Housing 18 over the Infinity Drive 20 (make sure that the feet are on the same side) and align the Cylinders 48 and Infinity Drive Support Poles 40 into their appropriate holes. Screw an Infinity Drive Support Pole Screw 42 through the Infinity Housing 18 into each of the Infinity Drive Support Poles 40, then rotate the engine and install the Infinity Drive Support Pole Screws 42 through the other Infinity Housing 18 into the Infinity Drive Support Poles 40.

Next, start with the Infinity Housing 18 that has the least amount of Infinity Drive 20 sticking out. Install another Infinity Housing Bearing 32 into the Infinity Housing 18. Then install a round Infinity Housing to Distribution Wheel Seal 36 into the Infinity Housing 18. Install an Infinity Housing Seal 34 into the Infinity Housing 18. Slide a round Distribution Wheel 22 with the grooves facing the Infinity Housing 18 onto the Infinity Drive 20. Bolt the Distribution Wheel 22 on to the Infinity Drive 20 using a Distribution Wheel Bolt 28 and a Distribution Wheel Washer 26. Next, install a Forward Manifold for Infinity Housing 14 over the Distribution Wheel 22 so that the high pressure inlet on the Forward Manifold for Infinity Housing 14 is perpendicular to the feet of the Infinity Housing 18. Attach using a Manifold and Shroud Bolt 44.

Next, turn the engine so that the other Infinity Housing 18 is accessible. Insert an Infinity Housing Bearings 32 into the Infinity Housing 18, and then insert the Infinity Housing Seal 34 and the Infinity Housing to Distribution Wheel Seal 36 into the Infinity Housing 18. Slide an Aft Distribution Wheel 30 with the grooved side facing the Infinity Housing 18 onto the Infinity Drive 20. Next, slide an Infinity Drive Extension 24 onto the Infinity Drive 20 and secure it with a Distribution Wheel Bolt 28 and Distribution Wheel Washer 26.

Next, insert an Aft Manifold for Infinity Housing Seal 62 into an Aft Manifold for Infinity Housing 14. Install Aft Manifold for Infinity Housing 14 over the Aft Distribution Wheel 30 and attach to the Infinity Housing 18 using the Manifold and Shroud Bolts 44. Be sure to align the high pressure inlet perpendicular to the feet of the Infinity Housing 18 and facing the same side as the forward end of the engine.

Next, install a Top Infinity Shroud 10 over the engine assembly and fasten to the Infinity Housings 18 using the Manifold and Shroud Bolts 44. When secured, install a Bottom Infinity Shroud 12 onto the Infinity Housings 18 and over the lips on the Top Infinity Shroud 10. The low pressure drain may be on either side of engine. For engine installation purposes a Mounting Ring 46 is installed onto the top of both Infinity Housings 18.

Thus, as generally described above, the embodiments disclosed herein provide numerous technical advantages over prior art systems and methods. For example, in one embodiment, The disclosed embodiments offer several advantages over prior art systems and methods. For example, in the illustrated embodiments, the infinity drive shaft includes a drive groove that forms a continuous and never-ending path around the axis of the drive shaft. Additionally, the pressure on the pistons is relieved before hitting top dead center, which helps preventing hammering, which can cause damage and increased wear.

Moreover, the disclosed embodiments also limit the number of moving parts. For example, in one embodiment, there are only five moving parts in a fully assembled hydraulic engine. One skilled in the art will understand that fewer moving parts translates to reduced wear and reduced repair expenses.

Additionally, the disclosed embodiments are considerably self-lubricating. As hydraulic fluid coats and lubricates the internal moving parts, such parts are maintained and preserved. And with less friction, the moving parts generate less heat, which also improves the longevity of both the moving parts and the hydraulic fluid itself.

Moreover, the disclosed embodiments can operate at low revolutions per minute (RPMs), while still producing rotational energy at the drive shaft. Additionally, the unique configurations disclosed herein can be applied to provide rotational energy in a wide variety of applications.

One skilled in the art will appreciate the embodiments disclosed above, and other features and functions, or alternatives thereof, may be desirably combined into many other different systems or applications. Additionally, various presently unforeseen or unanticipated alternatives, modifications, variations or improvements therein may be subsequently made by those skilled in the art, which are also intended to be encompassed by the following claims.

What is claimed is:

1. A system, comprising:

a hydraulic engine comprising a sump, the hydraulic engine configured to provide rotational energy to a load shaft;

wherein the hydraulic engine is further configured to receive pressurized hydraulic fluid and to collect hydraulic fluid in the sump;

a reservoir coupled to the sump and configured to receive hydraulic fluid from the sump, and to store retrieved hydraulic fluid;

a pump coupled to the reservoir and the hydraulic engine and configured to receive hydraulic fluid from the reservoir and to deliver hydraulic fluid to the hydraulic engine;

wherein the hydraulic engine comprises:

a first piston comprising a first piston shaft and a first drive pin;

a first piston cylinder comprising a first body and a first groove, wherein the first groove is configured to define a first aperture, the first aperture oriented axially along the first body and configured to receive the first drive pin;

wherein the first body is configured to enclose the first piston and to allow the first piston to travel axially within the first piston cylinder;

a drive shaft comprising an axis, a drive groove, and a surface, wherein the drive groove forms a continuous channel along the surface and is configured to receive the first drive pin;

a first distribution wheel comprising a first face, a second face, a first inlet aperture, and a first outlet aperture;

wherein the first distribution wheel is configured to couple to the first piston cylinder and to the drive shaft at a first end of the drive shaft, and to rotate axially with the drive shaft along the axis of the drive shaft;

wherein the first inlet aperture is configured to receive hydraulic fluid from the pump and to allow hydraulic fluid to pass through the first face and the second face;

wherein the first outlet aperture defines a groove on the second face and is configured to receive hydraulic fluid from the cylinder and to deliver hydraulic fluid to the sump.

2. The system of claim 1, further comprising:

a second distribution wheel coupled to the drive shaft and comprising a third face, a fourth face, a second inlet aperture, and a second outlet aperture;

wherein the second distribution wheel is configured to couple to the first piston cylinder and to the drive shaft at a second end of the drive shaft, and to rotate axially with the drive shaft along the axis of the drive shaft;

wherein the second inlet aperture is configured to receive hydraulic fluid from the pump and allow hydraulic fluid to pass through the third face and the fourth face; and wherein the second outlet aperture defines a groove on the fourth face and is configured to receive hydraulic fluid from the cylinder and to deliver hydraulic fluid to the sump.

3. The system of claim 2, wherein the second distribution wheel is further configured to rotate axially 180 degrees out of phase with the first distribution wheel.

4. The system of claim 1, further comprising a shell coupled to the first piston cylinder and the drive shaft and configured to enclose the first piston cylinder and the drive shaft.

5. The system of claim 1, further comprising:

a second piston comprising a second piston shaft and a second drive pin;

a second piston cylinder comprising a second body and a second groove, wherein the second groove is configured to define a second aperture, the second aperture oriented axially along the second body and configured to receive the second drive pin;

wherein the second body is configured to enclose the second piston and to allow the second piston to travel axially within the second piston cylinder; and wherein the drive groove is further configured to receive the second drive pin.

* * * * *